US008770276B1

(12) United States Patent
Nish et al.

(10) Patent No.: US 8,770,276 B1
(45) Date of Patent: Jul. 8, 2014

(54) DOWNHOLE TOOL WITH CONES AND SLIPS

(75) Inventors: Randall W. Nish, Provo, UT (US); Eric Brian Ackermann, Salt Lake City, UT (US)

(73) Assignee: Exelis, Inc., McLean, VA (US)

( * ) Notice: Subject to any disclaimer, the term of this patent is extended or adjusted under 35 U.S.C. 154(b) by 300 days.

(21) Appl. No.: 13/176,107

(22) Filed: Jul. 5, 2011

Related U.S. Application Data

(60) Provisional application No. 61/480,208, filed on Apr. 28, 2011.

(51) Int. Cl.
*E21B 23/06* (2006.01)
*E21B 33/129* (2006.01)

(52) U.S. Cl.
USPC ..... 166/138; 166/118

(58) Field of Classification Search
USPC ..... 166/118, 138
See application file for complete search history.

(56) References Cited

U.S. PATENT DOCUMENTS

| | | | |
|---|---|---|---|
| 2,043,225 | A | 6/1936 | Armentrout et al. |
| 2,160,804 | A | 5/1939 | Hall et al. |
| 2,205,119 | A | 6/1940 | Hall et al. |
| 2,230,712 | A | 2/1941 | Bendeler et al. |
| 2,249,172 | A | 7/1941 | Quintrell |
| 2,338,326 | A | 1/1944 | Green |
| 2,577,068 | A | 12/1951 | Baker |
| 2,589,506 | A | 3/1952 | Morrisett |
| 2,672,199 | A | 3/1954 | McKenna |
| 2,725,941 | A | 12/1955 | Hanshaw |
| 2,785,758 | A | 3/1957 | Baker |
| 3,021,902 | A | 2/1962 | Keithahn |
| 3,136,365 | A | 6/1964 | Carter et al. |
| 3,148,731 | A | 9/1964 | Holden |
| 3,163,225 | A | 12/1964 | Perkins |
| 3,211,232 | A | 10/1965 | Grimmer |
| 3,298,440 | A | 1/1967 | Current |
| 3,306,366 | A | 2/1967 | Muse |
| 3,314,480 | A | 4/1967 | Scott |
| 3,420,304 | A | 1/1969 | Kilgore |
| 3,497,003 | A | 2/1970 | Berryman et al. |
| 3,506,067 | A | 4/1970 | Lebourg |
| 3,517,742 | A | 6/1970 | Williams |
| 3,570,595 | A | 3/1971 | Berryman |

(Continued)

OTHER PUBLICATIONS

U.S. Appl. No. 13/362,185, filed Jan. 31, 2012; Randall W. Nish; office action dated Aug. 29, 2012.

(Continued)

*Primary Examiner* — Kenneth L Thompson
(74) *Attorney, Agent, or Firm* — Thorpe North & Western LLP

(57) ABSTRACT

A downhole tool with a frangible cone and slip system is disposable in a casing of an oil or gas well and includes a slip ring and a cone disposal on a mandrel. An interior of the slip ring and an exterior of the cone have mating flat facets circumscribing the interior or the exterior of the respective slip ring or cone, and forming an acute angle with respect to a longitudinal axis of the mandrel. The flat facets of the cone are contiguous with or bordering one another around a circumference of the cone, or are separated by a flush region substantially flush with adjacent flat facets, to form a substantially smooth circumference around the flat facets.

11 Claims, 7 Drawing Sheets

(56) References Cited

U.S. PATENT DOCUMENTS 3,831,677 A 8/1974 Mullins
3,976,133 A 8/1976 Allen
4,099,563 A 7/1978 Hutchison et al.
4,151,875 A 5/1979 Sullaway
4,285,398 A 8/1981 Zandmer et al.
4,289,200 A 9/1981 Fisher, Jr.
4,312,406 A 1/1982 McLaurin et al.
1,684,266 A 9/1982 Fisher et al.
4,359,090 A 11/1982 Luke
4,397,351 A 8/1983 Harris
4,432,418 A 2/1984 Mayland
4,488,595 A 12/1984 Akkerman
4,524,825 A 6/1985 Fore
4,532,989 A 8/1985 Barker
4,542,788 A 9/1985 Semar
4,553,596 A 11/1985 Graham et al.
4,664,188 A 5/1987 Zunkel et al.
4,665,977 A 5/1987 Mullins
4,708,202 A 11/1987 Sukup et al.
4,730,835 A 3/1988 Wilcox et al.
4,739,829 A 4/1988 Brunner
4,745,972 A 5/1988 Bell et al.
4,784,226 A 11/1988 Wyatt
4,813,481 A 3/1989 Sproul et al.
4,834,184 A 5/1989 Streich et al.
4,858,687 A 8/1989 Watson et al.
4,926,938 A 5/1990 Lindsey, Jr.
4,984,636 A 1/1991 Bailey et al.
5,086,839 A 2/1992 Setterberg, Jr. et al.
5,095,978 A 3/1992 Akkerman et al.
5,131,468 A 7/1992 Lane et al.
5,188,182 A 2/1993 Echols, III et al.
5,224,540 A 7/1993 Streich et al.
5,253,709 A 10/1993 Kendrick et al.
5,271,468 A 12/1993 Streich et al.
5,333,684 A 8/1994 Walter et al.
5,340,626 A 8/1994 Head
5,390,737 A 2/1995 Jacobi et al.
5,392,856 A 2/1995 Broussard, Jr. et al.
5,404,956 A 4/1995 Bohlen et al.
5,413,172 A 5/1995 Laurel
5,422,183 A 6/1995 Sinclair et al.
5,441,111 A 8/1995 Whiteford
5,479,986 A 1/1996 Gano et al.
5,540,279 A 7/1996 Branch et al.
5,542,473 A 8/1996 Pringle et al.
5,553,667 A 9/1996 Budde et al.
5,597,784 A 1/1997 Sinclair et al.
5,607,017 A 3/1997 Owens et al.
5,613,560 A 3/1997 Jelinski et al.
5,678,635 A 10/1997 Dunlap et al.
5,701,959 A 12/1997 Hushbeck et al.
5,749,419 A 5/1998 Coronado et al.
5,765,641 A 6/1998 Shy et al.
5,787,979 A 8/1998 Giroux et al.
5,813,457 A 9/1998 Giroux et al.
5,819,846 A 10/1998 Bolt, Jr.
5,837,656 A 11/1998 Sinclair et al.
5,839,515 A 11/1998 Yuan et al.
5,904,207 A 5/1999 Rubbo et al.
5,924,696 A 7/1999 Frazier
5,941,309 A 8/1999 Appleton
5,984,007 A 11/1999 Yuan et al.
5,990,051 A 11/1999 Ischy et al.
6,009,944 A 1/2000 Gudmestad
6,026,903 A 2/2000 Shy et al.
6,056,053 A 5/2000 Giroux et al.
6,076,600 A 6/2000 Vick, Jr. et al.
6,082,451 A 7/2000 Giroux et al.
6,131,663 A 10/2000 Henley et al.
6,145,593 A 11/2000 Hennig
6,167,957 B1 1/2001 Frazier
6,167,963 B1 1/2001 McMahan et al.
6,189,618 B1 2/2001 Beeman et al.
6,220,349 B1 4/2001 Vargus et al.
6,220,350 B1 4/2001 Brothers et al.
6,244,642 B1 6/2001 Serafin et al.
6,279,656 B1 8/2001 Sinclair et al.
6,318,461 B1 11/2001 Carisella
6,318,729 B1 11/2001 Pitts, Jr. et al.
6,354,372 B1 3/2002 Carisella et al.
6,394,180 B1 5/2002 Berscheidt et al.
6,412,388 B1 7/2002 Frazier
6,431,274 B1 8/2002 Nowlin et al.
6,481,496 B1 11/2002 Jackson et al.
6,491,108 B1 12/2002 Slup et al.
6,491,116 B2 12/2002 Berscheidt et al.
6,540,033 B1 4/2003 Sullivan et al.
6,578,633 B2 6/2003 Slup et al.
6,581,681 B1 6/2003 Zimmerman et al.
6,598,672 B2 7/2003 Bell et al.
6,598,679 B2 7/2003 Robertson
6,599,863 B1 7/2003 Palmer et al.
6,651,738 B1 11/2003 Solfronk et al.
6,651,743 B2 11/2003 Szarka
6,655,459 B2 12/2003 Mackay
6,666,275 B2 12/2003 Neal et al.
6,695,050 B2 2/2004 Winslow et al.
6,695,051 B2 2/2004 Smith et al.
6,708,768 B2 3/2004 Slup et al.
6,708,770 B2 3/2004 Slup et al.
6,712,153 B2 3/2004 Turley et al.
6,732,822 B2 5/2004 Slack et al.
6,752,209 B2 6/2004 Mondelli et al.
6,769,491 B2 8/2004 Zimmerman et al.
6,793,022 B2 9/2004 Vick et al.
6,796,376 B2 9/2004 Frazier
6,799,638 B2 10/2004 Butterfield, Jr.
6,827,150 B2 12/2004 Luke
6,976,534 B2 12/2005 Sutton et al.
6,986,390 B2 1/2006 Doane et al.
7,017,672 B2 3/2006 Owen, Sr.
7,036,602 B2 5/2006 Turley et al.
7,044,230 B2 5/2006 Starr et al.
7,049,272 B2 5/2006 Sinclair et al.
7,093,664 B2 8/2006 Todd et al.
7,124,831 B2 10/2006 Turley et al.
7,163,066 B2 1/2007 Lehr
7,168,494 B2 1/2007 Starr et al.
7,210,533 B2 5/2007 Starr et al.
7,255,178 B2 8/2007 Slup et al.
7,258,165 B1 8/2007 Williams
7,273,099 B2 9/2007 East, Jr. et al.
7,287,596 B2 10/2007 Frazier et al.
7,322,413 B2 1/2008 Rogers et al.
7,337,852 B2 3/2008 Manke et al.
7,350,582 B2 4/2008 McKeachnie et al.
7,353,879 B2 4/2008 Todd et al.
7,373,973 B2 5/2008 Smith et al.
7,380,600 B2 6/2008 Willberg et al.
7,395,856 B2 7/2008 Murray
7,452,161 B2 11/2008 Freyer et al.
7,455,118 B2 11/2008 Roberts et al.
7,461,699 B2 12/2008 Richard et al.
7,464,764 B2 12/2008 Xu
7,475,736 B2 * 1/2009 Lehr et al. ..... 166/386
7,510,018 B2 3/2009 Williamson et al.
7,735,549 B1 6/2010 Nish et al.
7,743,836 B2 6/2010 Cook et al.
7,789,135 B2 9/2010 Turley et al.
7,900,696 B1 3/2011 Nish et al.
7,980,300 B2 * 7/2011 Roberts et al. ..... 166/118
8,403,036 B2 * 3/2013 Neer et al. ..... 166/134
2002/0070503 A1 6/2002 Zimmerman et al.
2002/0162662 A1 11/2002 Passamaneck et al.
2003/0155112 A1 8/2003 Tiernan et al.
2003/0188862 A1 10/2003 Steich et al.
2003/0226660 A1 * 12/2003 Winslow et al. ..... 166/118
2004/0003928 A1 1/2004 Frazier
2004/0036225 A1 2/2004 Ritter et al.
2004/0045723 A1 3/2004 Slup et al.
2004/0177952 A1 9/2004 Turley et al.
2005/0077053 A1 4/2005 Walker et al.
2005/0161224 A1 7/2005 Starr et al.

(56) References Cited

U.S. PATENT DOCUMENTS

| | | | |
|---|---|---|---|
| 2005/0189103 | A1 | 9/2005 | Roberts et al. |
| 2005/0205264 | A1 | 9/2005 | Starr et al. |
| 2006/0124307 | A1 | 6/2006 | Turley et al. |
| 2006/0131031 | A1 | 6/2006 | McKeachnie et al. |
| 2006/0278405 | A1 | 12/2006 | Turley et al. |
| 2007/0039160 | A1 | 2/2007 | Turley et al. |
| 2007/0074873 | A1 | 4/2007 | McKeachnie et al. |
| 2007/0102165 | A1 | 5/2007 | Slup et al. |
| 2007/0119600 | A1 | 5/2007 | Slup et al. |
| 2007/0284097 | A1 | 12/2007 | Swor et al. |
| 2007/0284114 | A1 | 12/2007 | Swor et al. |
| 2008/0047717 | A1 | 2/2008 | Frazier et al. |
| 2008/0060821 | A1 | 3/2008 | Smith et al. |
| 2008/0073074 | A1 | 3/2008 | Frazier |
| 2008/0073081 | A1 | 3/2008 | Frazier et al. |
| 2008/0073086 | A1 | 3/2008 | Cook et al. |
| 2008/0202764 | A1 | 8/2008 | Clayton et al. |
| 2008/0257549 | A1 | 10/2008 | Swor et al. |
| 2009/0000792 | A1 | 1/2009 | Turley et al. |
| 2009/0038790 | A1 | 2/2009 | Barlow |
| 2009/0044957 | A1 | 2/2009 | Clayton et al. |
| 2009/0065194 | A1 | 3/2009 | Frazier |
| 2009/0065216 | A1 | 3/2009 | Frazier |
| 2009/0078647 | A1 | 3/2009 | Frazier et al. |
| 2009/0139720 | A1 | 6/2009 | Frazier |
| 2009/0159274 | A1 | 6/2009 | Frazier |
| 2009/0178808 | A1 | 7/2009 | Williamson et al. |
| 2010/0024703 | A1 | 2/2010 | Zampiello et al. |
| 2010/0155050 | A1 | 6/2010 | Frazier |
| 2010/0276159 | A1 | 11/2010 | Mailand et al. |
| 2010/0282004 | A1 | 11/2010 | Nance et al. |
| 2010/0288487 | A1 | 11/2010 | Turley et al. |
| 2011/0079383 | A1 | 4/2011 | Porter et al. |

OTHER PUBLICATIONS

U.S. Appl. No. 12/549,652, filed Aug. 28, 2009; Jason Vogel; Office Action issued Nov. 9, 2011.

U.S. Appl. No. 12/353,655, filed Jan. 14, 2009; Randall Nish; Notice of Allowance issued Nov. 2, 2011.

U.S. Appl. No. 12/916,095, filed Oct. 29, 2010; Randall William Nish; office action dated Mar. 20, 2013.

U.S. Appl. No. 12/253,337, filed Oct. 17, 2008; Randall W. Nish; office action dated May 2, 2013.

U.S. Appl. No. 13/362,185, filed Jan. 31, 2012; Randall W. Nish; office action issued May 2, 2012.

U.S. Appl. No. 12/549,652, filed Aug. 28, 2009; Jason Jon Vogel; office action issued Apr. 18, 2012.

U.S. Appl. No. 12/549,652, filed Aug. 28, 2009; Jason Jon Vogel; notice of allowance issued May 23, 2012.

Baker Hughes; Baker Oil Tools Remedial Systems Technical Unit QUIK Drill Composite Bridte Plug and Wireline Adapter Kit Product Family Nos. H40129 and H43848; Feb. 28, 2002; pp. 1-12.

Weatherford FracGaurd Composite Plugs; 2004; 7 pages.

BJ Python Composite Bridge Plug; Product Information; Sep. 20, 2001; 1 page.

Halliburton FAS Drill Squeeze Packers; Drillable Tools; 1999; 6 pages.

Weatherford Completion Systems FracGuard Series Composite Frac Plug 2001; Brochure No. 432.00 and 433.00; 2 pages.

BioBalls MR, Soluble Ball Sealers; www.santrol.com; Applicant believes that the Bioballs ere offered for sale prior to the filing date of applicant's application.

U.S. Appl. No. 12/253,319, filed Oct. 17, 2008; Randall Nish.

U.S. Appl. No. 12/253,337, filed Oct. 17, 2008; Randall Nish.

U.S. Appl. No. 12/353,655, filed Jan. 14, 2009; Randall Nish.

U.S. Appl. No. 12/549,652, filed Aug. 28, 2009; Vogel.

Composite Plugs; Magnum Oil Tools International; 19 pages.

U.S. Appl. No. 12/253,337, filed Oct. 17, 2008; Randall W. Nish; Notice of allowance issued Nov. 22, 2013.

* cited by examiner

DOWNHOLE TOOL WITH CONES AND SLIPS

PRIORITY CLAIM

Priority is claimed to U.S. Provisional Patent Application Ser. No. 61/480,208, filed on Apr. 28, 2011, which is hereby incorporated herein by reference in its entirety.

RELATED PATENT(S)/APPLICATION(S)

This is related to U.S. Pat. No. 7,735,549 (Ser. No. 11/800,448 filed May 3, 2007) and U.S. Pat. No. 7,900,696 (Ser. No. 12/253,319 filed Oct. 17, 2008); and U.S. patent application Ser. No. 12/353,655, filed Jan. 14, 2009, and claims priority to 61/089,302, filed Aug. 15, 2008; Ser. No. 12/253,337, filed Oct. 17, 2008; Ser. No. 12/549,652, filed Aug. 28, 2009, and claims priority to 61/230,345, filed Jul. 31, 2009; and Ser. No. 12/916,095, filed Oct. 29, 2010; which are hereby incorporated herein by reference in their entirety and for all purposes

BACKGROUND

1. Field of the Invention

The present invention relates generally to downhole tools, such as bridge and frac plugs, used to complete oil and/or gas wells.

2. Related Art

Oil and gas wells are completed using a complex process involving explosive charges and high pressure fluids. Once drilling is complete a well is lined with steel pipe backed with cement that bridges the gap between the pipe outer diameter (OD) and rock face. The steel/cement barrier is then perforated with explosive shaped charges. High pressure fluids and proppants (spherical sand or synthetic ceramic beads) are then pumped down the well, through the perforations and into the rock formation to prepare the rock for the flow of gas and oil into the casing and up the well. This fracturing process is repeated as many times as needed.

Another technological improvement has been the use of composite plugs used to complete these unconventional wells. Oil and gas wells are completed using a complex process whereby steel casing pipe is secured in place with cement. The steel/cement barrier and surrounding oil and gas bearing rock layers are then perforated with shaped charges in order to start the flow of oil and gas into the casing and up to the wellhead. As they prepare to perforate at each level, well technicians set a temporary plug in the bore of the steel casing pipe just below where they will perforate. This plug allows them to pump "Frac fluids" and sand down to the perforations and into the reservoir. This fractures the rock and props open the fractures allowing the movement of gas or oil towards the well at that level. Use of the temporary plug prevents contamination of already-fractured levels below. This process is repeated up the well until all desired zones have been stimulated. At each level, the temporary plugs are left in place, so that they can all be drilled out at the end of the process, in a single (but often time-consuming) operation. The ability to drill all the temporary composite plugs in a single pass (often taking only one day) compared to taking days or weeks to drill cast iron plugs has radically changed well completion economics.

Permanent and temporary plugs are locked to the casing using a system of cones and slips. The slip is typically made from cast iron or combinations of cast iron, ceramic buttons and composite materials. Each slip has hardened teeth or ceramic buttons that bite into the steel casing wall to lock the slip in place. The inside face usually consists of a conical surface that acts as a wedge. The slip's conical wedge face acts against a conical wedge formed by a cone. The cone is usually made from cast iron, aluminum or composite materials. The purpose of the cone is to act as a wedge to keep the slips locked in place and to provide support for the elastomeric elements used to seal the well bore.

Manufacturers use different designs to achieve this locking action and react the forces from the plug. Some manufacturers use a one piece cast iron slip and one piece cast iron cone. The slips have slots or grooves machined at equal intervals to assure the slips fracture when compressed and come in contact with the casing inner diameter (ID). The cones act as a conical wedge to fracture the slips and lock them in place against the casing wall. Such a cone-slip system does not assure equal spacing of the slip segments around the cone OD and casing ID. This causes uneven support of the cone and the plug to which it is connected. Examination of set plugs show gaps between slip segments can be as large as 1.5" in a plug designed for 4.5" casing. Further, as the surfaces of slip and cone contact each other they create extremely high point and line loads due to the contact profile created by unequal diameters of slip and cone. Cast iron plugs overcome these shortcomings with the brute force of massively over-designed cones and slips.

One manufacturer uses one piece cast iron slips and one piece composite cones made from fiberglass/epoxy material. The slips have slots or grooves which are used to set the breaking strength and spacing of the slip. The cones have brass pins used to crack and separate the broken slip segments. Such a cone-slip design can result in very high loads concentrated around a perimeter of contact between the cone and slip. At the beginning of the hydraulic fracturing process, the loads between cone and slip can be relatively light. As the temperature and pressure increases, the slip begins to crush and delaminate the cone as it presses itself into the cone (or deform the aluminum). Eventually, the cone can fail completely and the radial compressive loads from the slips transfer to the mandrel underneath the cone, whereupon, the mandrel begins to crush and fail.

Other manufacturers use a one piece cast iron slip with deep exterior grooves. These grooves allow the slip to fragment during the setting operation. The cone has a simple round conical outer diameter which acts against the conical slip to expand the slip segments and lock them to the casing wall. For example, see Magnum Oil Tools or Weatherford plugs. Such designs do not assure equal spacing of the slip segments around the cone and casing, causing uneven support of the cone and the plug to which it is connected. Further, as the surfaces of slip and cone contact each other they create extremely high point and line loads due to the contact profile created by unequal diameters of slip and cone.

Some manufacturers use a slip made of a cast iron toothed inserts molded to a composite backing piece. The slip segments are equally spaced around the plug circumference. For example, see Baker plugs. Such a design can assure that the slips are equally spaced around the cone to provide equal support to the cone and the plug body; but the composite material used as a support has a tendency to soften when exposed to the well fluids, high temperatures and pressures found in the well. The slip segments can be held together with non-metallic bands. For example, see BJ Services plugs. The slip segmented slips and backing rings can be held together with flat straps. When the plug is set the cables break and allow the slip segments to jump out to lock against the casing. For example, see Halliburton plugs. Such a design can assure that the slips are equally spaced around the cone to provide equal support to the cone and the plug body; but the flat straps can provide unreliable retention of the slip segments. If a strap loosens or breaks then the slip segment can catch against the casing wall and cause a premature set. A premature set causes the tool string (i.e. perforating guns, setting tool and plug) to become stuck. A stuck tool string costs tens to hundreds of thousands of dollars in direct and opportunity costs to remove. Some cone-slip system consists of a layer of segmented cast iron pieces with aluminum supports held together with a metal ring installed on the inside radius. The segments separate when the plug is set and move outward until they touch the casing. For example, see Smith Services plugs. Such a cone-slip system is entirely made from metal, which are often rejected by operators for their real or perceived long drill out times. Such a design can also have numerous and/or complex pieces used in the cone-slip system. All the designs with slip segments acting against a cone having flat facets also have flat facets separated by ridges equally spaced about the circumference of the cone.

When the plug is set, a setting sleeve compresses the stack of slips, cones and rubber elements. The rubber elements expand outward and inward and create a seal between the elements and mandrel and the elements and the inner diameter of the well casing. The rubber elements also act on one to two layers of sheet metal petals and force them into contact with the inner diameter of the steel casing. This prevents the rubber elements from extruding past the petals. The lock ring engages the threads in the mandrel and the threads in the push sleeve to prevent backward (i.e. upward) movement once the force from the setting tool is released. This locking action keeps pressure on the elements which preserves the seal and keeps the slips locked to the ID of the casing. This blocks fluid from getting to the lower layers of rock and creates the seal needed to perform hydraulic fracturing in the layers above the plug.

Examples of downhole tools include US Patent Publication No. 2011/0079383; and U.S. Pat. Nos. 4,926,938; 5,540,279; 6,491,108; and 6,695,050.

SUMMARY OF THE INVENTION

It has been recognized that it would be advantageous to develop a downhole tool, such as a bridge or frac plug, and/or a frangible cone and slip system thereof, with comparatively low contact forces, and that assures equal spacing of each slip segment without the use of crack starter pins, retaining bands or complex cone geometry.

The invention provides a downhole tool disposable in a casing of an oil or gas well. The tool has a mandrel with an element disposed thereon compressible and radially expandable to seal between the mandrel and the casing. A slip ring is disposed thereon radially expandable to engage the casing. A cone is adjacent the slip ring to radially displace the slip ring. The element, the slip ring and the cone are pressable against a lower anvil on the mandrel. The slip ring and the cone have mating ends, with the slip ring having a tapering wider open end, and the cone having a tapering narrower end insertable into the open end of the slip ring. An interior of the open end of the slip ring and an exterior of the tapering narrower end of the cone each have discrete flat facets circumscribing an interior of the open end of the slip ring and an exterior of the tapering narrower end of the cone. The tapering narrower end of the cone has a substantially smooth circumference circumscribing the flat facets. The substantially smooth circumference extends along an entire longitudinal length of the flat facets and tapering narrower end of the cone.

In addition, the invention provides a downhole tool disposable in a casing of an oil or gas well. The tool includes an element carried by a mandrel and axially displaceable along the mandrel during setting and compressible, and radially expandable to seal between the mandrel and the casing when set. At least one a slip ring is carried by the mandrel and is radially expandable during setting to engage the casing when set. At least one cone is carried by the mandrel and is adjacent the at least one slip ring and is axially displaceable during setting to radially displace the slip ring. A lower anvil is fixed with respect to the mandrel. An upper push sleeve is carried by the mandrel, with the element, the at least one slip ring and the at least one cone located between the upper push sleeve and the lower anvil. The upper push sleeve is axially displaceable during setting to press the element, the at least one slip ring and the at least one cone between the upper push sleeve assembly and the lower anvil on the mandrel. The slip ring has a tapering open end. The cone has a tapered circular frusto-conical end insertable into the tapering open end of the slip ring. The slip ring and the cone have mating flat facets circumscribing an interior of the open end of the slip ring and an exterior of the end of the cone. The flat facets are oriented at an acute angle with respect to a longitudinal axis of the mandrel. The flat facets are formed at discrete intervals around the tapered circular frusto-conical end of the cone and interrupted by intervening portions of the tapered circular frusto-conical end. The flat facets of the cone are substantially flush with the intervening portions along the entire longitudinal length of the flat facets to form a substantially smooth circumference around the flat facets free of raised ridges between the flat facets. The slip ring has a plurality of slots circumscribing the slip ring and alternating with the flat facets. The plurality of slots extends from the open end of the slip ring at least partially along the flat facets. The slots are free of the cone or structure thereof.

Furthermore, the invention provides a frangible cone and slip system configured for a downhole tool device disposable in a casing of an oil or gas well. The system includes a slip ring disposable on a mandrel and radially expandable to engage the casing. A cone is disposable on a mandrel adjacent the slip ring to radially displace the slip ring. The slip ring and the cone have mating ends, with the slip ring having a tapering wider open end, and the cone having a tapering narrower end insertable into the open end of the slip ring. An interior of the open end of the slip ring and an exterior of the tapering narrower end of the cone each have discrete flat facets circumscribing an interior of the open end of the slip ring and an exterior of the tapering narrower end of the cone. The tapering narrower end of the cone has a substantially smooth circumference circumscribing the flat facets. The substantially smooth circumference extends along an entire longitudinal length of the flat facets and tapering narrower end of the cone.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein.

Figure 1A:
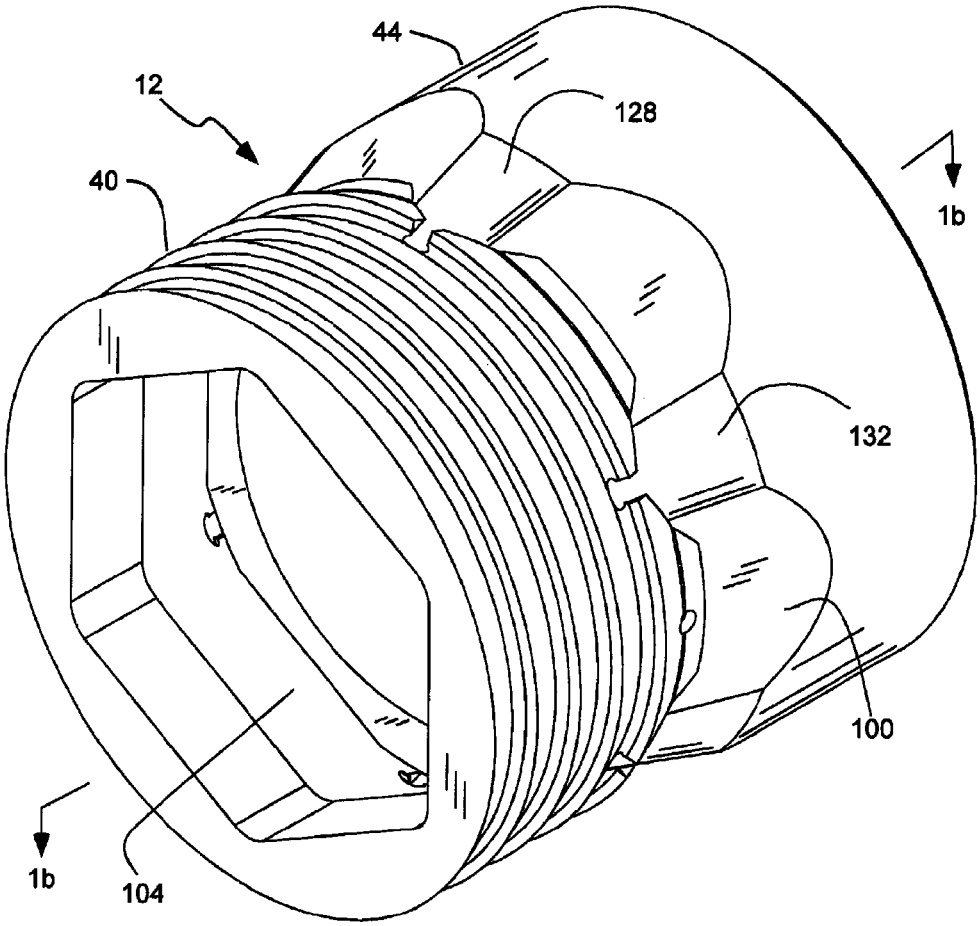
FIG. 1*a* is a perspective view of a cone and slip assembly in accordance with an embodiment of the present invention.

Reference will now be made to the exemplary embodiments illustrated, and specific language will be used herein to describe the same. It will nevertheless be understood that no limitation of the scope of the invention is thereby intended.

DETAILED DESCRIPTION OF EXAMPLE EMBODIMENT(S)

Definitions

The terms "upper" and "lower" are used herein with respect to the orientation of the plug in an upright, vertical orientation, even though the plug can be used in horizontal orientations or wells, where upper is still towards the upper end of the well and lower is still towards the lower end of the well.

The terms "casing", "pipe" and "well" are used interchangeably herein.

The terms "slips" and "slip rings" are used interchangeably herein.

The terms "spool" and "mandrel" are used interchangeably herein.

The terms "cone" and "slip wedge" are used interchangeably herein.

The terms "downhole tool" and "plug" and "mandrel assembly" are used interchangeably herein.

The terms "hexagonal cones" and "hexagonal slips" are used generally or broadly to refer to respective cones (or slip wedges) or slips with flats or flat facets thereon or circumscribing their perimeter, and which may include six flats of flat facets, or any other number, such as heptagons or octagons.

Specification

As illustrated in FIGS. 1*a*-4*d*, a downhool tool or plug or mandrel assembly, indicated generally at 10 (FIGS. 4*a*-*d*), in an example implementation in accordance with the invention is shown for use in a casing or pipe of an oil or gas well. The plug 10 includes a slip/cone assembly 12 (FIGS. 1*a*, 1*b* and 4*a*-*d*) or system with comparatively low contact forces that also assures equal spacing of each slip segment without the use of crack starter pins or complex cone geometry.

The plug 10 can be configured as one of various different type plugs, such as a bridge plug to restrict flow in either direction (up and down), a fracture ("frac") plug to restrict flow in one direction (typically down), a soluble insert plug that begins as a bridge plug, but then transitions to a frac plug after a predetermined time or condition in the well, etc. It will be appreciated that the plug can be configured as other types of plugs as well. Various aspects of such plugs are shown in U.S. patent application Ser. No. 11/800,448 (U.S. Pat. No. 7,735,549); Ser. No. 12/253,319 (U.S. Pat. No. 7,900,696); Ser. Nos. 12/253,337; 12/353,655 (61/089,302); Ser. No. 12/549,652 (61/230,345); and Ser. No. 12/916,095; which are herein incorporated by reference.

The plug 10 includes a center mandrel or mandrel 20 (FIGS. 4*a*-*d*) that can be made of, or that can include, a composite material, such as a fiber in a resin matrix. The mandrel 20 holds or carries various other components which allow it to be coupled to a setting tool that is lowered into the casing of the well, and which allow it to engage and seal with the casing. Thus, the mandrel has an outer diameter less than an inner diameter of the casing of the well. The mandrel can have a center bore 24 (FIG. 4*c*) which can allow for the flow from the reservoir below when the plug is configured as a frac plug. In addition, the mandrel can have a seat 28 (FIG. 4*c*) disposed in the bore 24. The seat can be formed by an internal annular flange in the bore. The upper portion of the bore, at a top of the plug, and the seat can be configured to receive various different components to determine the type of plug and operating characteristics. For example, a fixed bridge plug can be fixed in the upper portion of the bore and can abut to the seat to seal the bore and form the plug as a bridge plug. As another example, a ball or the like can be movably retained in the upper portion of the bore and movable against and away from the seat, forming a one way check valve, to configure the plug as a frac plug.

One or more elements 32 (FIGS. 4*a*-*d*) are disposed on and carried by the mandrel. The elements 32 can include one or more compressible rings. Under longitudinal or axial pressure or force, the elements compress longitudinally and expand radially (outward to the casing of the well and inwardly to the mandrel) to fill a space between the mandrel and the casing of the well, thus forming a seal. In addition, one or more backing rings 36 (FIGS. 4*b* and 4*c*), such as upper and lower backing rings, can be disposed at opposite sides of the elements and carried by the mandrel to resist longitudinal or axial extrusion of the elements under pressure. One or more slips or slip rings 40 (FIGS. 1*a*, 1*b*, 3*a*-3*c*; 4*a*-4*c*) (such as upper and lower slips or slip rings) are disposed at opposite sides of the elements and carried by the mandrel. The slips 40 can have teeth on the exterior surface, and can expand or fracture radially to engage and grip the casing of the well. One or more cones 44 (FIGS. 1*a*-1*d*; 2*a*-2*d*; 4*a*-4*d*) (such as upper and lower cones) or slip wedges can be carried by the mandrel and associated with each of the one or more slips adjacent the slips to radially displace and fracture the slip rings as a cone and slip ring are pressed together.

Above and below these components are a push sleeve or assembly 48 (FIGS. 4*a*-*d*) and a lower anvil or mule shoe 52 (FIGS. 4*a*-*d*) which are structural features designed to resist the hydrostatic, hydrodynamic and compression loads acting on the plug and the elements and their related hardware. Thus, the setting tool presses down on the push sleeve assembly 48, which in turn presses the components against the anvil 52 (or the upper anvil, aka push sleeve, at the opposite end), causing the elements to expand radially and seal, and causing the slips to fracture, slide outward on the cones, and radially bite into the casing to secure the plug in place. As indicated above, components installed in the upper end of the mandrel determine whether the plug will act as a "frac" or "bridge" plug or some other type of plug. The plug can be field configurable, such as by a tool hand "on site" at the well, as a bridge, frac, and/or soluble insert plug. The plug can be shipped direct to the field as described above, with an assembly of elements to seal the casing; backing rings, cones and slips on the mandrel. These components are crushed, pressed or compressed as a setting sleeve acts upon the push sleeve assembly. The elements are forced out to seal the steel casing's inner diameter and the compression load needed to create and maintain the seal is maintained by the slips which lock to the casing's inner diameter. The compression loads acting on the slips are about 25,000 lbs, and must be maintained for weeks or even months at a time.

Figure 4A:
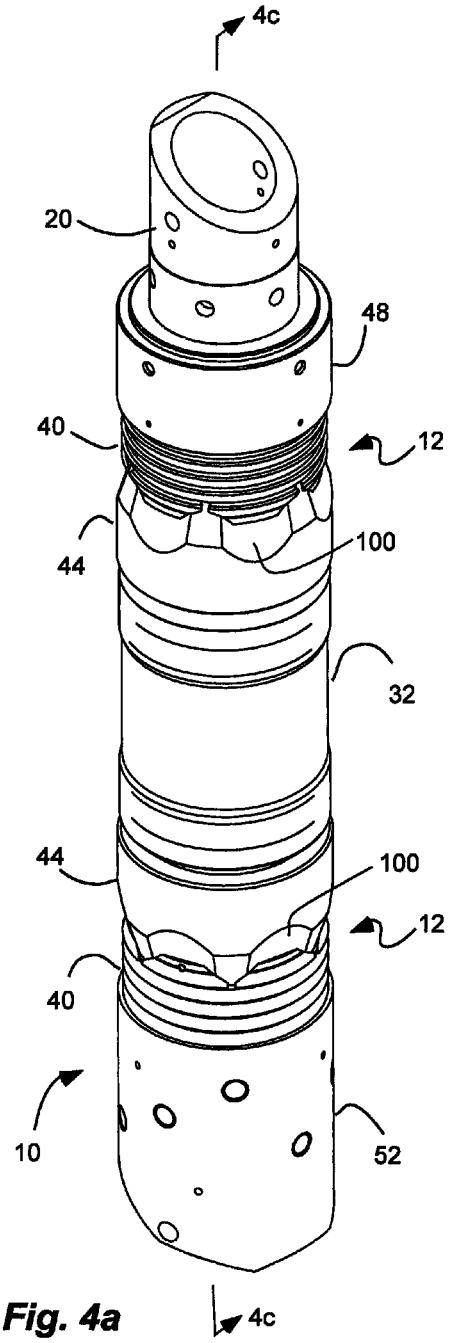
FIG. 4*a* is a perspective view of a downhole tool or plug with the cone and slip assembly of FIG. 1*a;*
Figure 4B:
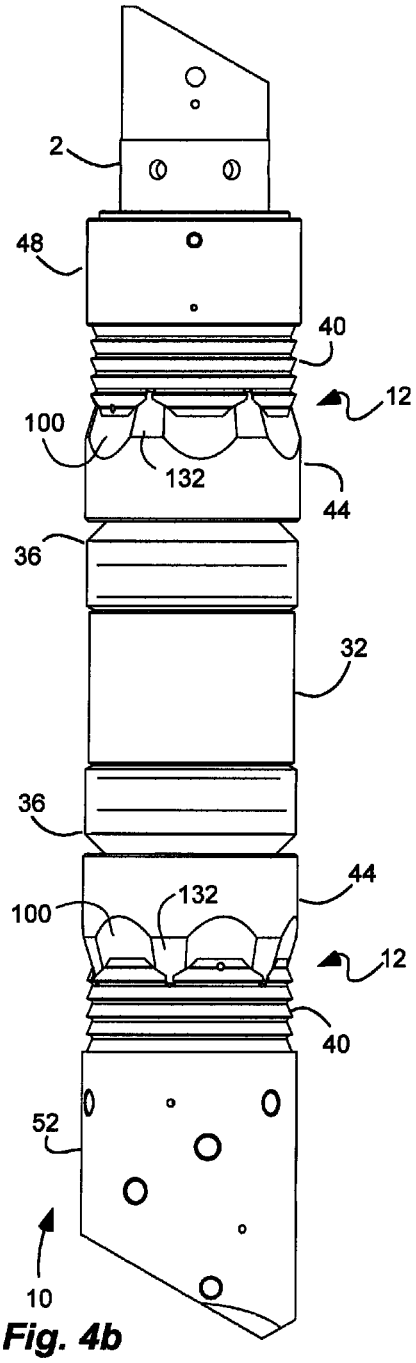
FIG. 4*b* is a side view of the downhole tool or plug of FIG. 4*a;*
Figure 4C:
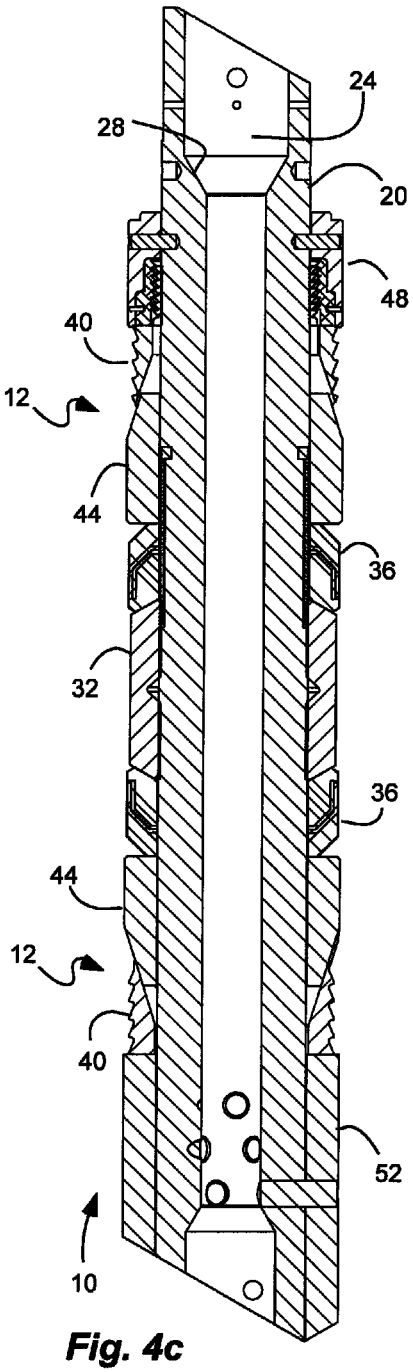
FIG. 4*c* is a cross-sectional side view of the downhole tool or plug of FIG. 4*a* taken along line 4*c;*
Figure 4D:
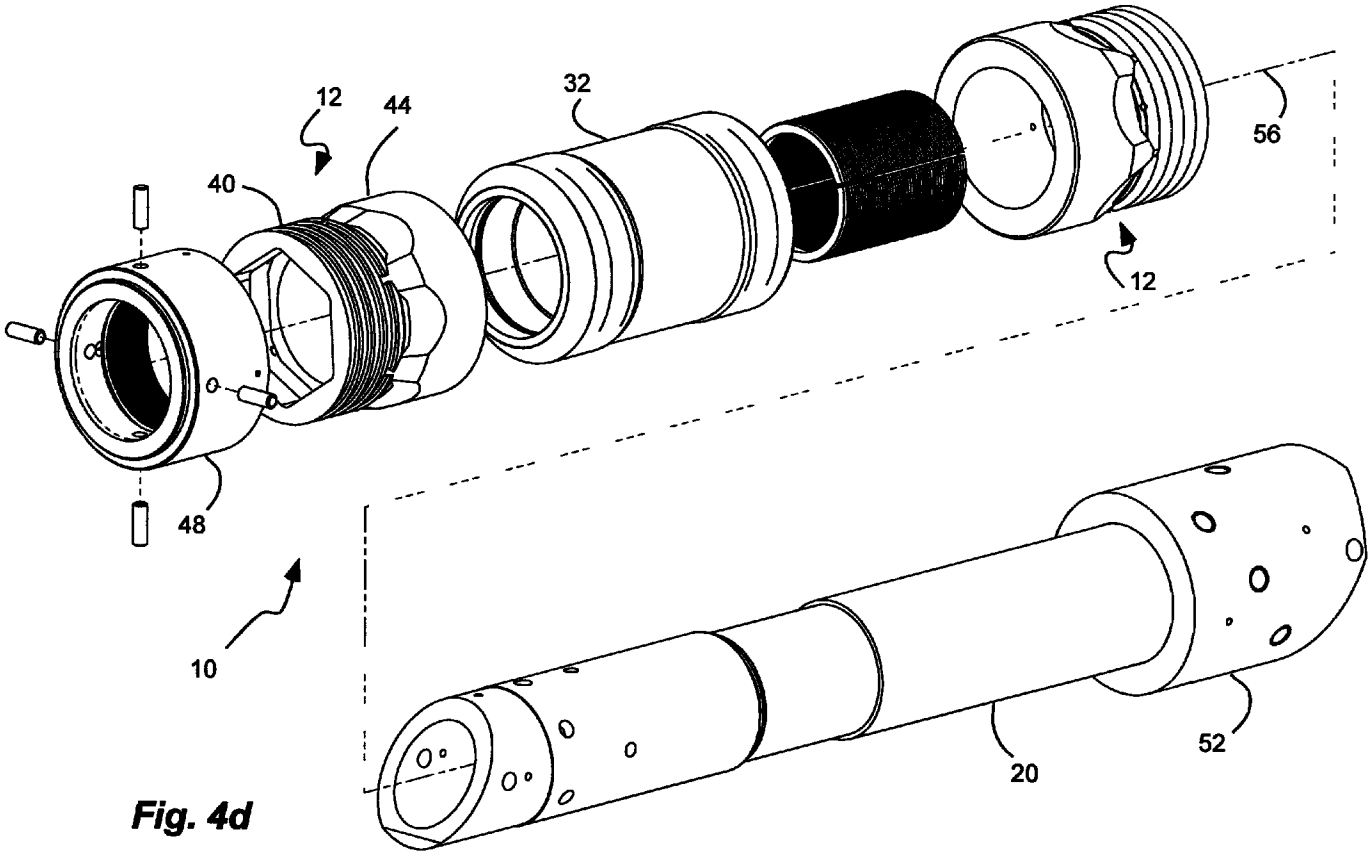
FIG. 4*d* is an exploded view of the downhole tool or plug of FIG. 4*a*.

As described above, the mandrel 20 (FIGS. 4*a*, 4*b*, 4*d*) can be formed of, or can include, a composite material. The mandrel 20 can have a substantial diameter, except for annular recesses, and except for the anvil 52, which can formed with the mandrel resulting in a larger lower diameter, or affixed thereto such as with pins. Similarly, the cones 44 can be formed of, or can include, a composite material, such as fiberglass or carbon. Alternatively, the cones and/or mandrel can be formed of metal, such as aluminum. The slips can be formed of metal, such as cast iron. The cast iron material of the slips assists in securing the plug in the well casing, while the composite material of the mandrel and the cones eases the drill out procedure. The plug or mandrel can have a longitudinal axis 56 (FIG. 4*d*).

During setting, a setting tool can pull up on the mandrel while holding (or pressing down) on the push sleeve assembly. Thus, the element(s), slips, cones, etc. are pressed between the upper push sleeve assembly and the anvil. In addition, the push sleeve assembly, and other of the components, displace or translate axially towards the anvil.

The plug 10 and/or the slip/cone assembly 12 provide a low cost, frangible cone and slip system with comparatively low contact forces. The cone-slip system 12 also can assure equal spacing of each slip segment, without the use of crack starter pins or complex cone geometry. The cone-slip system 12 can include a one piece composite cone 44 with discrete flat surfaces or facets 100 (FIGS. 1*a*-1*b*; 2*a*-2*d*; 4*a*) machined around the outer diameter or circumference. Thus, the cone can be referred to as a "hexagonal cone." (It will be appreciated that six flat surfaces or facets forming a hexagon is shown by way of example, and that the number of flat surfaces or facets can vary.)

Figure 1B:
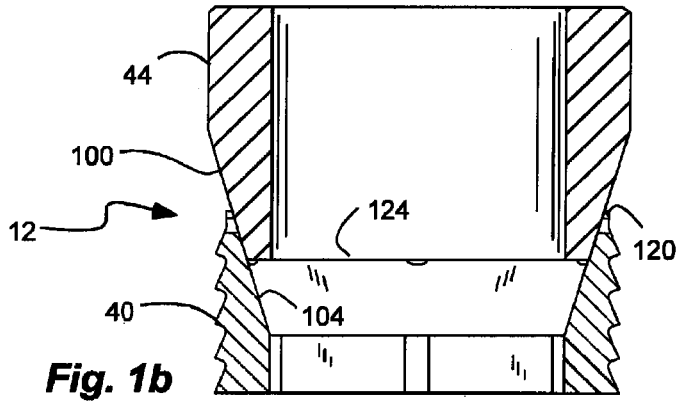
FIG. 1*b* is a cross-sectional side view of the cone and lip assembly of FIG. 1*a* taken along line 1*b;*

The cone 44 nests inside the slip 40 having a round outer diameter, but a matching "hexagonal" recess with matching or mating flat facets 104 (FIGS. 1*a*-1*b*; 3*a*-3*c*). Slots 110 (FIG. 3*a*) are located in the corners of the hexagonal recess to assure uniform and predictable fracturing at those locations. When compressed, the slip 40 fractures into six segments which bite into the steel casing inner diameter. The shape of the slip and cone assures they break uniformly and are equally spaced around the cone.

Tests have shown the viability of this design approach for both reliable fracture, even spacing and significantly improved contact stress profile. Further the slip-cone assembly 12 eliminates the need for 12 to 16 brass crack starter pins, their holes and related operations. This is a further advantage because it reduces the metal content of the plug, which improves costs, drill out times and customer perceptions.

Referring to FIGS. 1*a*-3*b*, the slip ring 40 and the cone 44 have mating ends with mating flat facets 100 and 104. The slip ring 40 has a tapering wider open end 120 (FIG. 1*b*; 3*a*, 3*c*). Thus, the flat facets 104 of the slip ring 40 circumscribe an interior of the open end 120 and are oriented at an acute angle with respect to the longitudinal axis 56 (FIG. 4*d*) of the mandrel 20 to form the tapering wider open end. An inner end of the facets 104 form a smaller inner diameter of the slip ring at an interior of the ring, while an outer end of the facets form a larger inner diameter of the slip ring at the open end. The facets 104 of the slip ring 40 can be wider and thicker at their inner end at the interior of the ring, and narrower and thinner at their outer end at the open end of the ring. The flat facets 104 of the slip ring 40 can have adjacent sides or edges that form a radius corner. Alternatively, the flat facets of the slip ring can border one another or be contiguous with one another at their adjacent sides. The slip ring 40 further comprises the plurality of slots 110 circumscribing the slip ring, and alternating with the flat facets 104. The plurality of slots 110 can extend from the tapering wider open end 120 of the slip ring and at least partially along a longitudinal length of the flat facets. As described above, the plurality of slots 110 can be free of the cone or structure thereof, such as the brass crack starter pins.

The cone 44 has a tapering narrower end 124 (FIGS. 1*b*; 2*c*-2*d*) insertable into the open end 120 of the slip ring 40, as shown in FIGS. 1*a* and 1*b*. The flat facets 100 or the cone 44 mate or match the flat facets 104 of the slip ring 40. (It will be appreciated that prior to setting, only a portion of the flat facets are engaged with one another; but that during setting the flat facets slid along one another.) The flat faces 100 and 104 on the cone and slip reduce load concentrations compared to cone-on-cone contact. The flat facets 100 of the cone 44 circumscribe and exterior of the end 124 and are oriented at an acute angle with respect to the longitudinal axis 56 (FIG. 4*d*) of the mandrel 20 to form or help form the tapering narrower end. The tapering narrower end 124 of the cone 44 can have a circular frusto-conical end 128 (FIGS. 1*a*; 2*a*-2*b*) (i.e. a truncated circular conical shape) with the flat facets 100 formed therein at discrete intervals circumscribing the circular frusto-conical end, and interrupted by intervening portions 132 (FIGS. 1*a*; 2*a*-2*c*) of the circular frusto-conical end. The flat facets 100 can be machined at equal distances around the outer diameter of a fiberglass cone. The facets 100 can have a longer longitudinal length than the intervening portions 132, or can extend beyond the circular frusto-conical end 128 and into a cylindrical portion of the cone. The facets 100 of the cone 44 can be thinner at the end 124 and thicker at the inner portion of the cone. Similarly, the intervening portions 132 can be thinner at the end 124 and thicker at the inner portion of the cone. The ends of the intervening portions 132 at the end 124 of the cone can be thicker than the ends of the facets 100 at the end of the cone.

The tapering narrower end 124 of the cone 44 can have a substantially smooth circumference circumscribing the flat facets 100 and the intervening portions 132. The flat facets 100 of the cone 44 can be substantially flush with the intervening portions 132 along the entire longitudinal length of the flat facets, the intervening portions, and/or the frusto-conical end to form the substantially smooth circumference around the flat facets, and being free of raised ridges between the flat facets. The substantially smooth circumference can extend along an entire longitudinal length of the flat facets 100 and tapering narrower end 124 (and circular frusto-conical end 128) of the cone 44. Adjacent flat facets 100 of the cone 44 can be free of raised ridges between the flat facets along the entire longitudinal length thereof. The adjacent flat facets 100 of the cone 44 can be separated by a flush region substantially flush with adjacent flat facets along the entire longitudinal length thereof. The intervening portions can form the flush region. The flat facets 100 are flat while the intervening portions 132 have a broad curvature.

The cone-slip system can include a one piece composite cone with flat surfaces machined around the outer diameter, and an iron slip ring. Alternatively, the cone and/or the slip can be formed of composite, fiberglass, carbon fiber, aluminum, iron, etc.

Figure 5:
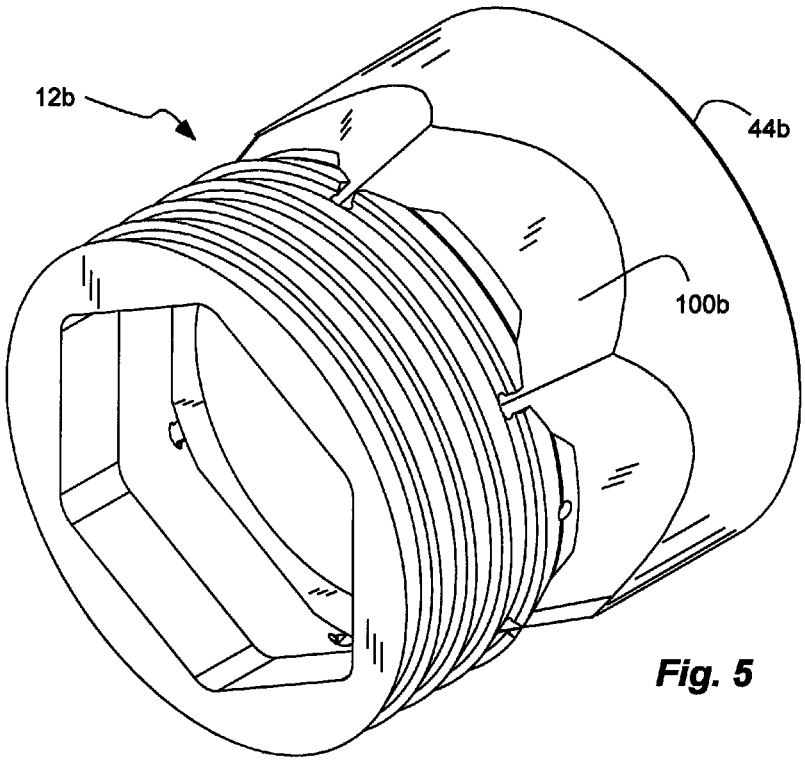
FIG. 5 is a perspective view of another cone and slip assembly.

Referring to FIG. 5, another cone-slip system 12*b* can have a cone 44*b* with flat facets 100*b* bordering one another around the circumference of the cone along the entire longitudinal length of the facets. The flat facets 100*b* of the cone 44*b* can be contiguous with or bordering one another around a circumference of the cone forming a substantially smooth circumference circumscribing the flat facets, and being free of raised ridges between the flat facets.

In accordance with another aspect of the invention, the cone can include crack starter pins.

Figure 2A:
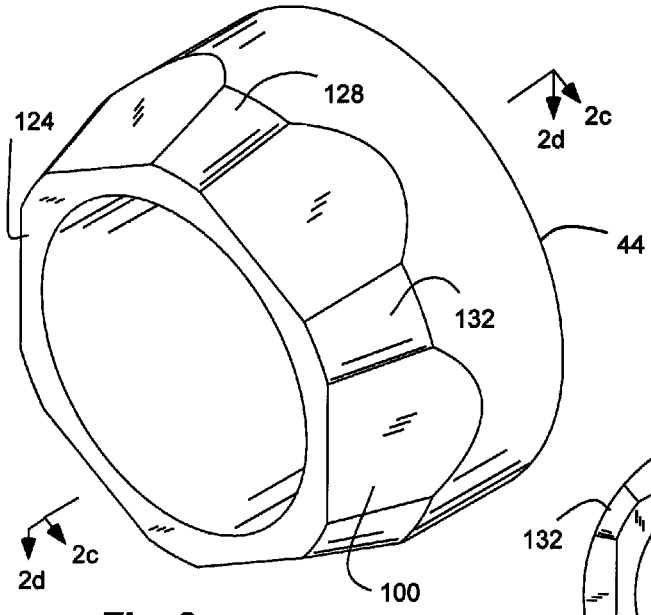
FIG. 2*a* is a perspective view of a cone of FIG. 1*a;*
Figure 2B:
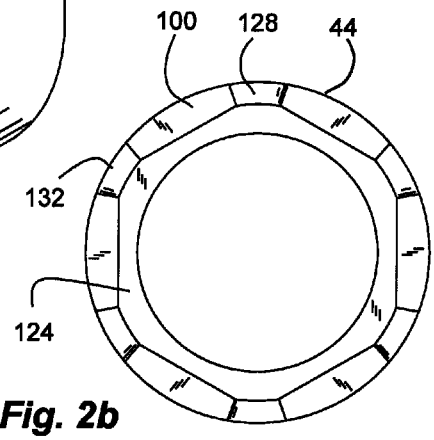
FIG. 2*b* is an end view of the cone of FIG. 2*a;*
Figure 2D:
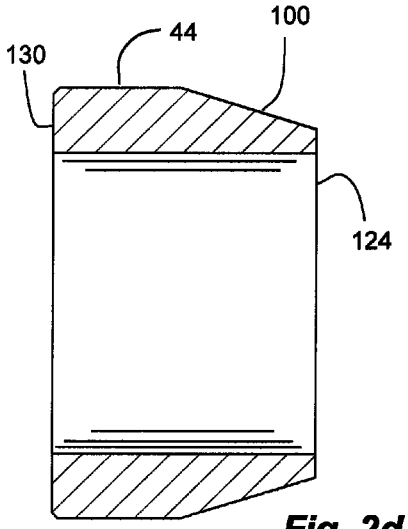
FIG. 2*d* is a cross-sectional side view of the cone of FIG. 2*a* taken along line 2*d;*
Figure 2C:
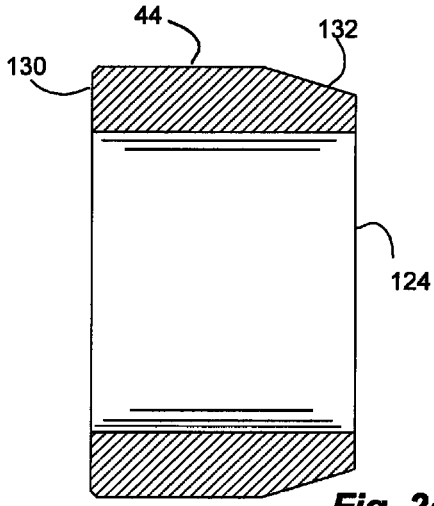
FIG. 2*c* is a cross-sectional side view of the cone of FIG. 2*a* taken along line 2*c;*
Figure 3A:
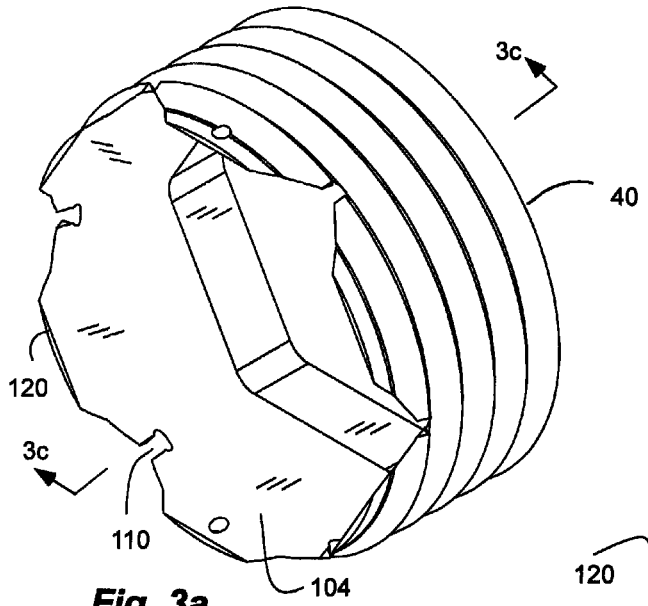
FIG. 3*a* is a perspective view of a slip of FIG. 1*a;*
Figure 3C:
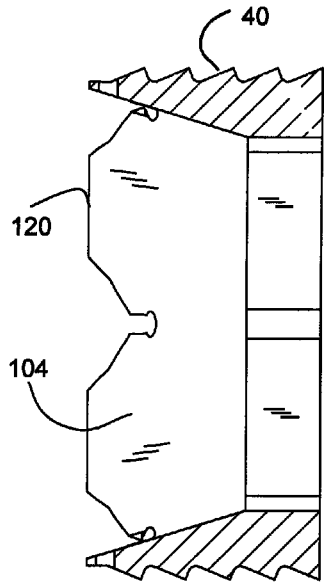
FIG. 3*c* is a cross-sectional side view of the slip of FIG. 3*a* taken along line 3*c;*
Figure 3B:
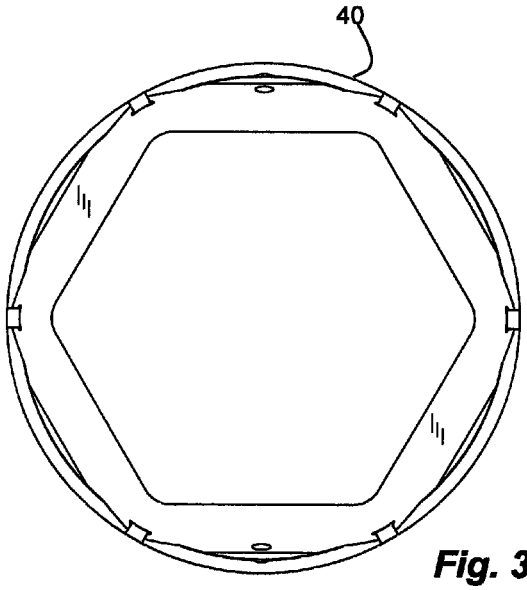
FIG. 3*b* is an end view of the slip of FIG. 3*a;*
Figure 2E:
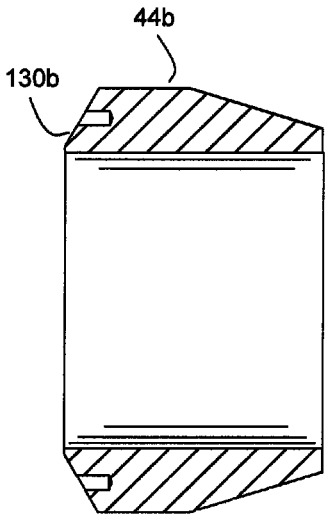
FIG. 2*e* is a cross-sectional side view of another cone.
Figure 2F:
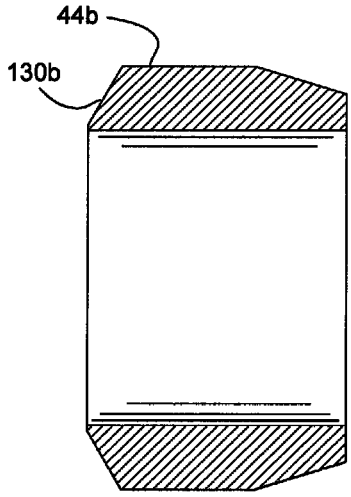
FIG. 2*f* is a cross-sectional side view of another cone.

Referring to FIGS. 2*c* and 2*d*, the cone 44 can have an opposite end 130, opposite the tapering narrower end 124, that is blunt or has a face orthogonal to or perpendicular to the longitudinal axis. Referring to FIGS. 2*e* and 2*f*, another cone 44*c* can have an opposite end 130*b* that is tapered or angled.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The invention claimed is:

1. A downhole tool device disposable in a casing of an oil or gas well, the device comprising:

a) a mandrel with an element disposed thereon compressible and radially expandable to seal between the mandrel and the casing, and with a slip ring disposed thereon radially expandable to engage the casing, and with a cone adjacent the slip ring to radially displace the slip ring, and with the element, the slip ring and the cone being pressable against a lower anvil on the mandrel;

b) the slip ring and the cone having mating ends, with the slip ring having a tapering wider open end, and the cone having a tapering narrower end insertable into the open end of the slip ring;

c) an interior of the open end of the slip ring and an exterior of the tapering narrower end of the cone each having discrete flat facets circumscribing an interior of the open end of the slip ring and an exterior of the tapering narrower end of the cone; and d) the tapering narrower end of the cone having a substantially smooth circumference circumscribing the flat facets, the substantially smooth circumference being free of raised ridges between the flat facets, the substantially smooth circumference extending along an entire longitudinal length of the flat facets and tapering narrower end of the cone.

2. A device in accordance with claim 1, wherein adjacent flat facets of the cone are separated by a flush region substantially flush with adjacent flat facets along the entire longitudinal length thereof.

3. A device in accordance with claim 1, wherein the tapering narrower end of the cone has a circular frusto-conical end with the flat facets formed therein at discrete intervals circumscribing the circular frusto-conical end and interrupted by intervening portions of the circular frusto-conical end.

4. A device in accordance with claim 1, wherein the flat facets of the cone are bordering one another around the circumference of the cone along the entire longitudinal length of the facets.

5. A device in accordance with claim 1, wherein the slip ring further comprises a plurality of slots circumscribing the slip ring and alternating with the flat facets, the plurality of slots extending from the tapering wider open end of the slip ring at least partially along the flat facets, and the plurality of slots being free of the cone or structure thereof.

6. A downhole tool device disposable in a casing of an oil or gas well, the device comprising:

a) a mandrel;

b) an element carried by the mandrel and axially displaceable along the mandrel during setting and compressible and radially expandable to seal between the mandrel and the casing when set;

c) at least one a slip ring carried by the mandrel and radially expandable during setting to engage the casing when set;

d) at least one cone carried by the mandrel and adjacent the at least one slip ring and axially displaceable during setting to radially displace the slip ring;

e) a lower anvil fixed with respect to the mandrel;

f) an upper push sleeve carried by the mandrel, with the element, the at least one slip ring and the at least one cone located between the upper push sleeve and the lower anvil, the upper push sleeve being axially displaceable during setting to press the element, the at least one slip ring and the at least one cone between the upper push sleeve assembly and the lower anvil on the mandrel;

g) the slip ring having a tapering open end;

h) the cone having a tapered circular frusto-conical end insertable into the tapering open end of the slip ring;

i) the slip ring and the cone having mating flat facets circumscribing an interior of the open end of the slip ring and an exterior of the end of the cone, and the flat facets oriented at an acute angle with respect to a longitudinal axis of the mandrel;

j) the flat facets formed at discrete intervals around the tapered circular frusto-conical end of the cone and interrupted by intervening portions of the tapered circular frusto-conical end, the flat facets of the cone being substantially flush with the intervening portions along the entire longitudinal length of the flat facets to form a substantially smooth circumference around the flat facets free of raised ridges between the flat facets; and k) the slip ring having a plurality of slots circumscribing the slip ring and alternating with the flat facets, the plurality of slots extending from the open end of the slip ring at least partially along the flat facets, and the slots being free of the cone or structure thereof.

7. A frangible cone and slip system configured for a downhole tool device disposable in a casing of an oil or gas well, the system comprising:

a) a slip ring disposable on a mandrel and radially expandable to engage the casing;

b) a cone disposable on a mandrel adjacent the slip ring to radially displace the slip ring;

c) the slip ring and the cone having mating ends, with the slip ring having a tapering wider open end, and the cone having a tapering narrower end insertable into the open end of the slip ring;

d) an interior of the open end of the slip ring and an exterior of the tapering narrower end of the cone each having discrete flat facets circumscribing an interior of the open end of the slip ring and an exterior of the tapering narrower end of the cone; and e) the tapering narrower end of the cone having a substantially smooth circumference circumscribing the flat facets, the substantially smooth circumference being free of raised ridges between the flat facets, the substantially smooth circumference extending along an entire longitudinal length of the flat facets and tapering narrower end of the cone.

8. A system in accordance with claim 7, wherein adjacent flat facets of the cone are separated by a flush region substantially flush with adjacent flat facets along the entire longitudinal length thereof.

9. A system in accordance with claim 7, wherein the tapering narrower end of the cone has a circular frusto-conical end with the flat facets formed therein at discrete intervals circumscribing the circular frusto-conical end and interrupted by intervening portions of the circular frusto-conical end.

10. A system in accordance with claim 7, wherein the flat facets of the cone are bordering one another around the circumference of the cone along the entire longitudinal length of the facets.

11. A system in accordance with claim 7, wherein the slip ring further comprises a plurality of slots circumscribing the slip ring and alternating with the flat facets, the plurality of slots extending from the tapering wider open end of the slip ring at least partially along the flat facets, and the plurality of slots being free of the cone or structure thereof.

* * * * *